US010962925B2

(12) United States Patent
Kamoshida et al.

(10) Patent No.: US 10,962,925 B2
(45) Date of Patent: Mar. 30, 2021

(54) ERRONEOUS MOUNTING PREVENTION SYSTEM

(71) Applicant: CANON KABUSHIKI KAISHA, Tokyo (JP)

(72) Inventors: Shigemi Kamoshida, Yokohama (JP); Isao Koishi, Yokohama (JP); Daisuke Yamamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/799,280

(22) Filed: Feb. 24, 2020

(65) Prior Publication Data

US 2020/0272095 A1 Aug. 27, 2020

(30) Foreign Application Priority Data

Feb. 27, 2019 (JP) ..... JP2019-034906

(51) Int. Cl.
*G03G 15/00* (2006.01)
*G03G 21/18* (2006.01)

(52) U.S. Cl.
CPC ..... *G03G 21/1842* (2013.01)

(58) Field of Classification Search
USPC ..... 399/12, 13
See application file for complete search history.

(56) References Cited

U.S. PATENT DOCUMENTS

| | | | | |
|---|---|---|---|---|
| 7,962,069 | B2 * | 6/2011 | Kurenuma | G03G 15/0872 399/258 |
| 9,519,261 | B2 | 12/2016 | Leemhuis | |
| 2009/0175653 | A1 * | 7/2009 | Kamimura | G03G 21/1832 399/117 |
| 2009/0290904 | A1 * | 11/2009 | Kawai | G03G 21/185 399/111 |
| 2013/0163998 | A1 * | 6/2013 | Mizusawa | G03G 21/1871 399/12 |
| 2014/0086628 | A1 | 3/2014 | Toriyama et al. | |
| 2017/0153596 | A1 | 6/2017 | Takahashi | |
| 2017/0310883 | A1 * | 10/2017 | Tanabe | H04N 5/23287 |

FOREIGN PATENT DOCUMENTS

| | | | |
|---|---|---|---|
| EP | 3074822 | B1 | 8/2018 |
| JP | 6049376 | B2 | 12/2016 |
| RU | 2624148 | C2 | 6/2017 |

* cited by examiner

*Primary Examiner* — Q Grainger
(74) *Attorney, Agent, or Firm* — Canon U.S.A., Inc. I.P. Division

(57) ABSTRACT

There is provided an erroneous mounting prevention system in which, by moving a second cartridge in a mounting direction to mount the second cartridge on a first apparatus main body, a protruding portion is brought into abutment with a surface portion, and, by moving a first cartridge in the mounting direction to mount the first cartridge on the first apparatus main body, the first cartridge is mounted on the first apparatus main body without being restricted from being moved by the surface portion.

4 Claims, 14 Drawing Sheets

ERRONEOUS MOUNTING PREVENTION SYSTEM

BACKGROUND OF THE INVENTION

Field of the Invention

The present invention relates to a system for preventing erroneous mounting of a cartridge on an apparatus main body of an image forming apparatus.

Description of the Related Art

There has been widely known a configuration improving replacement convenience by unitizing process units, such as a photosensitive drum, and consumables, such as a toner container, into a cartridge, for an electrophotographic image forming apparatus.

Meanwhile, there may be a plurality of types of cartridges and a plurality of types of apparatus main bodies for image forming apparatuses. Japanese Patent No. 06049376 discusses an erroneous mounting prevention mechanism for preventing a cartridge incompatible with the apparatus main body from being mounted on the apparatus main body in this case.

SUMMARY OF THE INVENTION

According to an aspect of the present invention, an erroneous mounting prevention system includes a first cartridge including a first restricted portion, a second cartridge including a protruding portion and a second restricted portion, a first apparatus main body configured to allow the first cartridge to be mounted thereon and prevent the second cartridge from being mounted thereon, and a second apparatus main body configured to prevent the first cartridge from being mounted and allow the second cartridge to be mounted on the second apparatus main body, the second apparatus main body including a recessed portion and a restriction member configured to be movable between a restriction position in which the first and second cartridges are restricted to be mounted thereon and a non-restriction position in which the first and second cartridges are not restricted to be mounted thereon, wherein the first cartridge includes no portion corresponding to the protruding portion of the second cartridge, and the first apparatus main body includes a surface portion at a position corresponding to the recessed portion of the second apparatus main body and includes no member corresponding to the restriction member of the second apparatus main body, wherein by moving the second cartridge in a mounting direction to mount the second cartridge on the second apparatus main body, the protruding portion passes through the recessed portion and is brought into abutment with the restriction member to move the restriction member from the restriction position to the non-restriction position, thereby the second restricted portion passes through a region in which the restriction member is located when the restriction member is in the restriction position, so that the second cartridge is allowed to be mounted on the second apparatus main body, wherein by moving the first cartridge in the mounting direction to mount the first cartridge on the second apparatus main body, the first restricted portion is brought into abutment with the restriction member located at the restriction position, thereby the first cartridge is restricted to be moved in the mounting direction and is prevented from being mounted on the second apparatus main body, wherein by moving the second cartridge in the mounting direction to mount the second cartridge on the first apparatus main body, the protruding portion is brought into abutment with the surface portion, thereby the second cartridge is restricted to be moved in the mounting direction and is prevented from being mounted on the first apparatus main body, and wherein by moving the first cartridge in the mounting direction to mount the first cartridge on the first apparatus main body, the first cartridge is mounted on the first apparatus main body without being restricted from being moved by the surface portion.

Further features of the present invention will become apparent from the following description of exemplary embodiments with reference to the attached drawings.

DESCRIPTION OF THE EMBODIMENTS

Figure 1A:
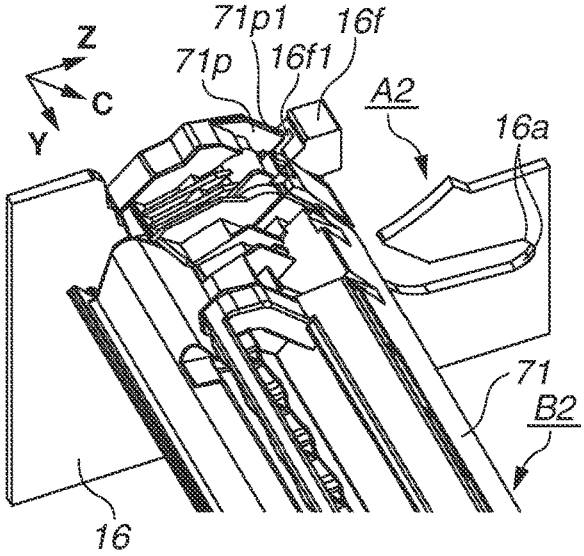
FIGS. 1A, 1B, 1C, and 1D are perspective diagrams and partial detailed diagrams illustrating mounting of a cartridge onto an image forming apparatus, respectively.

A cartridge and an image forming apparatus according to an exemplary embodiment of the present invention will be described with reference to the drawings. In the following description, the image forming apparatus and the cartridge will be described, using a laser beam printer and a cartridge used in the laser beam printer as examples thereof.

In the following description, a longitudinal direction Y is defined to match a direction along a rotational axis of a photosensitive drum, which is an image bearing member.

Further, a driven side and a non-driven side are defined to refer to a side to which driving is transmitted from a main body of the image forming apparatus to the photosensitive drum and an opposite side therefrom in the longitudinal direction Y, respectively.

Further, the reference numerals in the description are intended to facilitate the reference to the drawings, and are not intended to limit the configuration.

[Overall Configuration of Image Forming Apparatus]

A configuration in common between a first apparatus main body A1 and a second apparatus main body A2, and a configuration in common between a first cartridge B1 and a second cartridge B2, in configurations of an apparatus main body and a cartridge of an image forming apparatus according to a first exemplary embodiment, will be described with reference to FIGS. 2 and 3. Hereinafter, a configuration described as the apparatus main body A will indicate the configuration in common between the first apparatus main body A1 and the second apparatus main body A2, and a configuration described as the cartridge B will indicate the configuration in common between the first cartridge B1 and the second cartridge B2.

Figure 2:
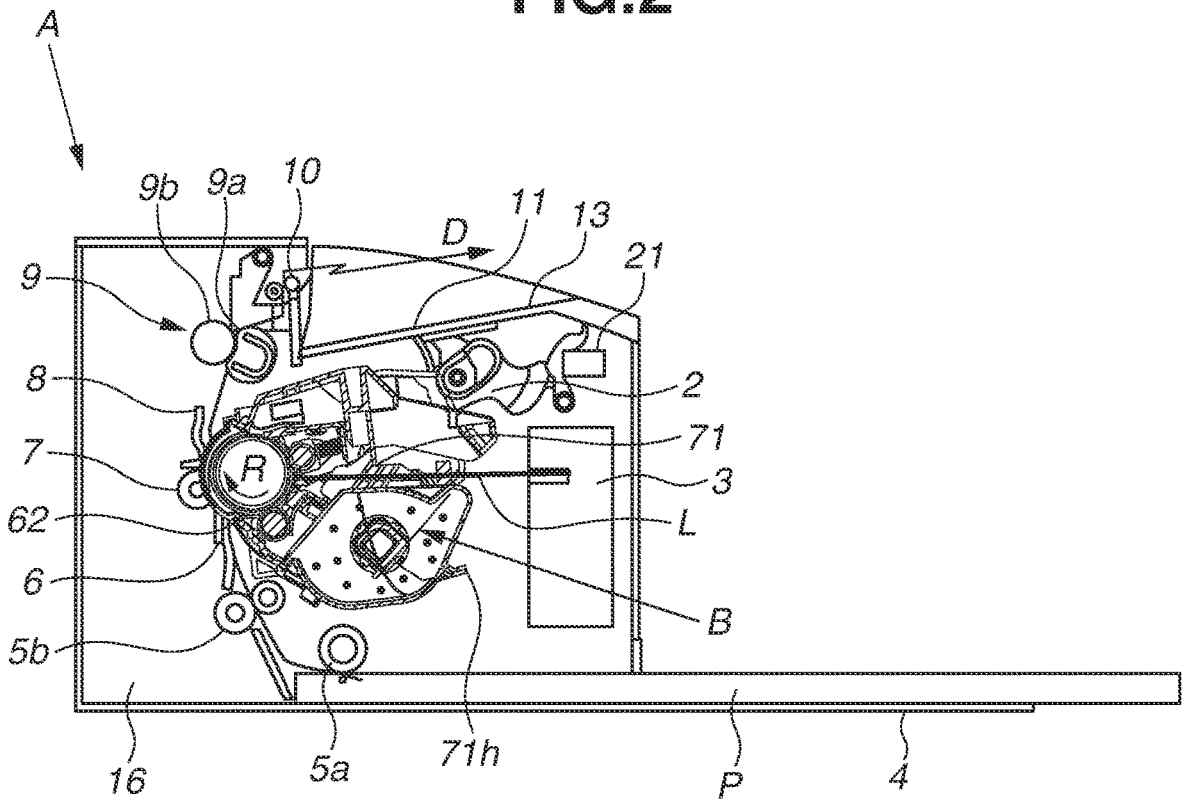
FIG. 2 is a cross-sectional diagram schematically illustrating the image forming apparatus.

FIG. 2 is a cross-sectional diagram of the apparatus main body A and the cartridge B. FIG. 3 is a cross-sectional diagram of the cartridge B. The apparatus main body A refers to the image forming apparatus with the cartridge B removed therefrom.

The image forming apparatus illustrated in FIG. 2 is a laser beam printer which the cartridge B is attachable to and detachable from the apparatus main body A, and using the electrophotographic technique.

A sheet tray 4, on which a recording medium used to form an image thereon (hereinafter referred to as a "sheet P") is stacked, is disposed vertically below the cartridge B.

Further, a pickup roller 5*a*, a pair of feeding rollers 5*b*, a transfer guide 6, a transfer roller 7, a conveyance guide 8, a fixing device 9, a pair of discharge rollers 10, a discharge tray 11, and the like are disposed in the apparatus main body A in series along a direction D in which the sheet material P is conveyed. The fixing device 9 includes a heating roller 9*a* and a pressing roller 9*b*.

[Image Forming Process]

Next, an image forming process will be schematically described. A photosensitive drum 62 is rotationally driven at a predetermined circumferential speed (process speed) in a direction indicated by an arrow R based on a print start signal.

A charging roller (charging member) 66 with a bias voltage applied thereto is in contact with an outer peripheral surface of the photosensitive drum 62, and evenly charges the outer peripheral surface of the photosensitive drum 62.

A laser scanner 3 as an exposure device outputs laser light L based on image information. This laser light L passes through a laser opening 71*h* provided on a drum frame member 71 of the cartridge B, and scans and exposes the outer peripheral surface of the photosensitive drum 62. As a result, an electrostatic latent image based on the image information is formed on the outer peripheral surface of the photosensitive drum 62.

Figure 3:
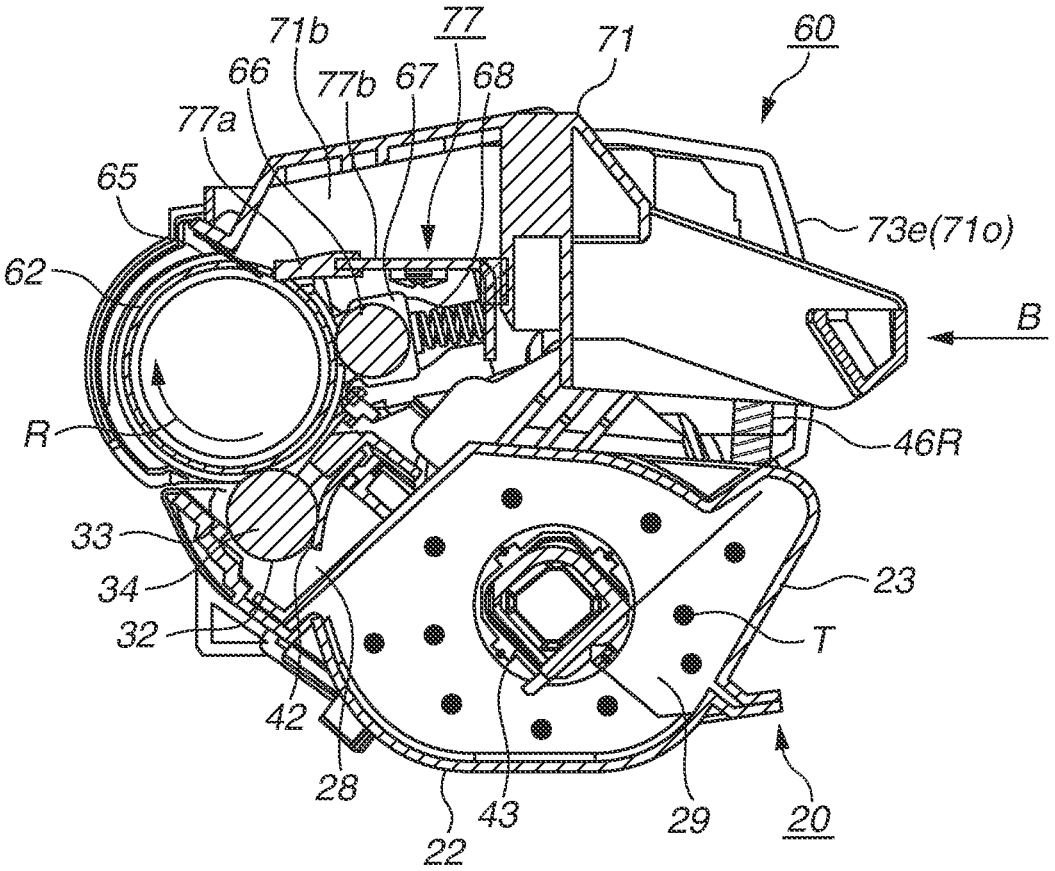
FIG. 3 is a cross-sectional diagram schematically illustrating the cartridge.

On the other hand, as illustrated in FIG. 3, toner T in a toner chamber 29 is stirred and conveyed by a rotation of a conveyance member (stirring member) 43 and is fed out to a toner supply chamber 28 in a development unit 20 as a development device.

The toner T is borne on a surface of a development roller 32 due to a magnetic force of a magnet roller 34 (stationary magnet). The development roller 32 is a developer bearing member that bears a developer (toner T) on a surface thereof to develop the latent image formed on the photosensitive drum 62. While the toner T is triboelectrically charged by a development blade 42, a layer thickness of the toner T is regulated on the circumferential surface of the development roller 32 as the developer bearing member. The toner T is supplied to the photosensitive drum 62 based on the electrostatic latent image, and develops the latent image. As a result, the latent image is visualized as a toner image. The photosensitive drum 62 is an image bearing member that bears the latent image and the toner image, which is an image formed with the toner T, on the surface thereof. Further, as illustrated in FIG. 2, the sheet material P stored in a lower portion of the apparatus main body A is fed out from the sheet tray 4 by the pickup roller 5*a* and the pair of feeding rollers 5*b* in synchronization with a timing at which the laser light L is output. Then, this sheet material P is conveyed to a transfer position between the photosensitive drum 62 and the transfer roller 7 via the transfer guide 6. The toner image is sequentially transferred from the photosensitive drum 62 onto the sheet material P at this transfer position.

The sheet material P with the toner image transferred thereon is separated from the photosensitive drum 62 and conveyed to the fixing device 9 along the conveyance guide 8. Then, the sheet material P passes through a fixing nip portion formed by the heating roller 9*a* and the pressing roller 9*b* that form the fixing device 9. The sheet material P with the toner image formed thereon is subjected to pressing and heating fixing processing at this fixing nip portion, and thereby the toner image is fixed onto the sheet material P. The sheet material P subjected to the processing for fixing the toner image is conveyed to the pair of discharge rollers 10 and discharged onto the discharge tray 11.

On the other hand, as illustrated in FIG. 3, the photosensitive drum 62 after the transfer is subjected to removal of residual toner on the outer peripheral surface therefrom by a cleaning blade 77, and is used for the image forming process again. The toner T removed from the photosensitive drum 62 is stored in a waste toner chamber 71*b* of a drum unit 60. The drum unit 60 is a unit including the photosensitive drum 62.

In the above-described configuration, the charging roller 66, the development roller 32, the transfer roller 7, and the cleaning blade 77 are process units that work on the photosensitive drum 62.

[Overall Configuration of Cartridge]

Figure 4:
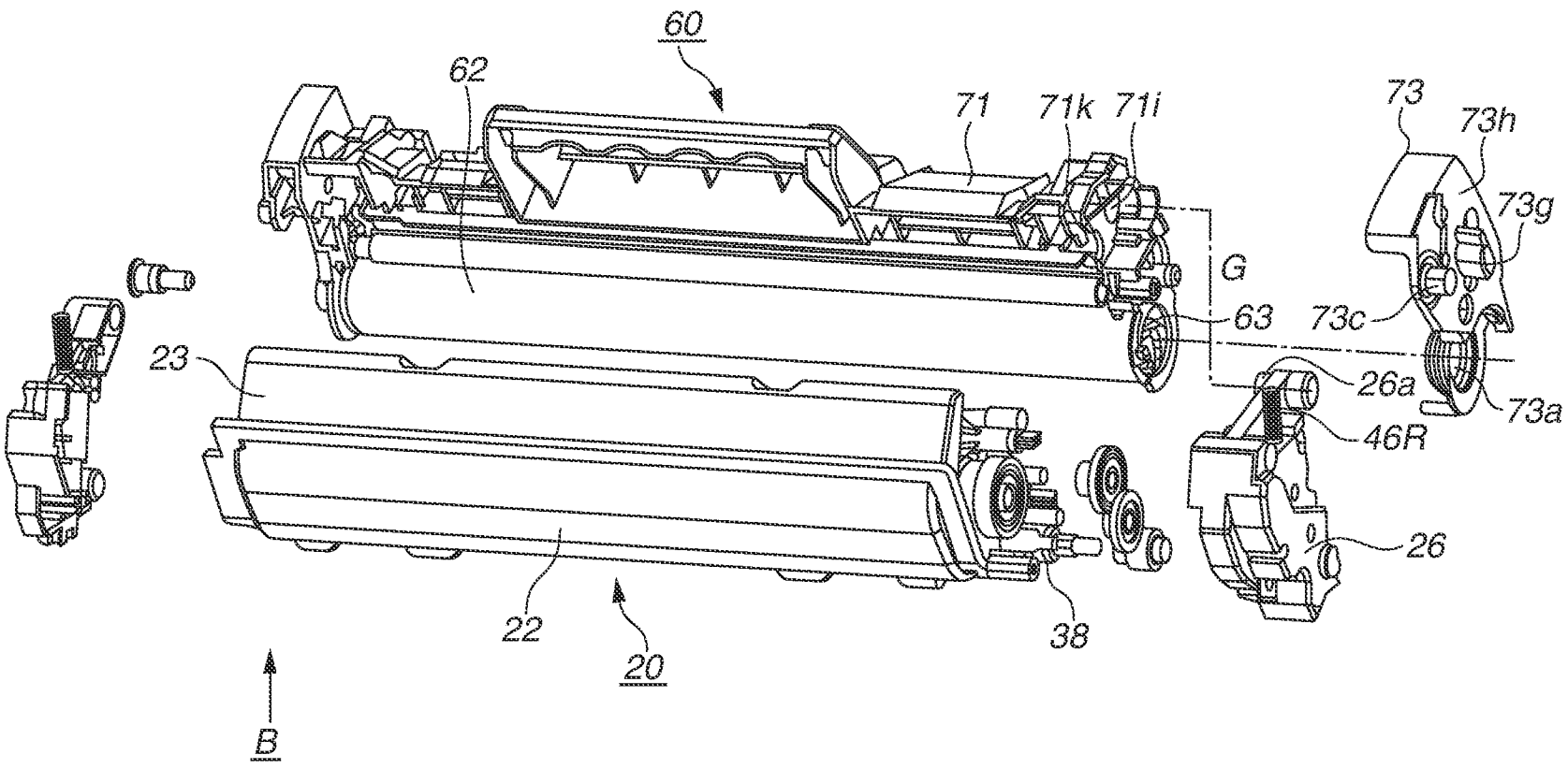
FIG. 4 is an exploded diagram of the cartridge.

Next, an overall configuration of the cartridge B will be described with reference to FIGS. 3, 4, and 5. FIG. 3 is a cross-sectional view of the cartridge B, and FIGS. 4 and 5 are perspective diagrams illustrating the configuration of the cartridge B.

The cartridge B includes the drum unit 60 and the development unit 20. The cartridge B is a unit formed by unitizing the photosensitive drum 62 and at least one of the process units working thereon into a cartridge. The cartridge B is configured to be attachable to and detachable from the apparatus main body A of the image forming apparatus. Examples of the process units include the charging unit, the development unit, and the cleaning unit.

As illustrated in FIG. 3, the drum unit 60 includes the photosensitive drum 62, the charging roller 66, the cleaning blade 77, and the drum frame member 71 supporting them. On the photosensitive drum 62, a driven-side drum flange 63 provided on the driven side is rotatably supported by a hole portion 73*a* of a drum bearing 73 on the driven side as the other end side (refer to FIG. 4). In a broad sense, the drum bearing 73 and the drum frame member 71 can also be collectively referred to as the drum frame member.

Figure 5:
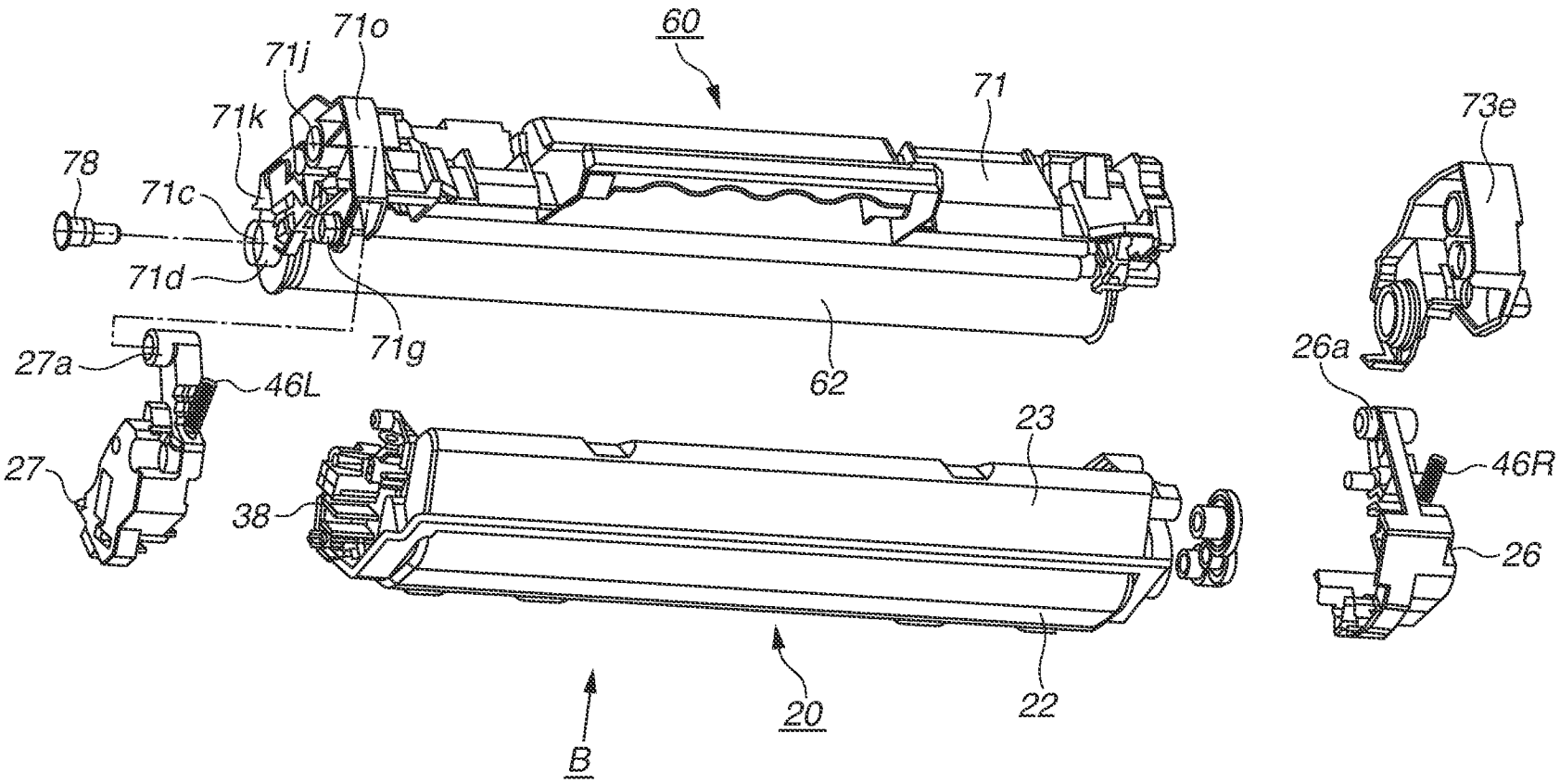
FIG. 5 is an exploded diagram of the cartridge.

The photosensitive drum 62 is configured in such a manner that a hole portion (not illustrated) of a drum flange on the non-driven side is rotatably supported by a drum shaft 78, which is press-fitted in a hole portion 71*c* provided on the drum frame member 71, on the non-driven side as one end side as illustrated in FIG. 5.

Each of the drum flanges is a borne portion rotatably supported by the bearing portion. In the drum unit 60, the charging roller 66 and the cleaning blade 77 are each disposed in contact with the outer peripheral surface of the photosensitive drum 62.

The cleaning blade 77 includes a rubber blade 77*a*, which is a blade-shaped elastic member made of rubber as an elastic material, and a support member 77*b* supporting the rubber blade 77*a*. The rubber blade 77*a* is in abutment with the photosensitive drum 62 in a counter direction to a rotational direction of the photosensitive drum 62. In other words, the rubber blade 77*a* is in abutment with the photosensitive drum 62 in such a manner that a distal end portion thereof faces an upstream side in the rotational direction of the photosensitive drum 62.

As illustrated in FIG. 3, the waste toner removed from the surface of the photosensitive drum 62 by the cleaning blade 77 is stored in the waste toner chamber 71*b* formed by the drum frame member 71 and the cleaning blade 77.

Further, as illustrated in FIG. 3, a sheet member 65 for preventing a leak of the waste toner from the drum frame member 71 is provided at an edge portion of the drum frame member 71 so as to abut against the photosensitive drum 62.

The charging roller 66 is rotatably attached to the drum unit 60 via charging roller bearings 67 at both end portions of the drum frame member 71 in the longitudinal direction Y. The charging roller bearings 67 are each pressed toward the photosensitive drum 62 by a biasing member 68, by which the charging roller 66 is in pressure contact with the photosensitive drum 62. The charging roller 66 is driven to be rotated following the rotation of the photosensitive drum 62.

As illustrated in FIG. 3, the development unit 20 includes the development roller 32, a developer container 23 supporting the development roller 32, the development blade 42, and the like. The development roller 32 is rotatably attached to the developer container 23 via bearing members 26 (see FIG. 4) and 27 (see FIG. 5) provided at both ends.

Further, the magnet roller 34 is provided in the development roller 32. The development blade 42 for regulating the toner layer on the development roller 32 is disposed in the development unit 20. As illustrated in FIGS. 4 and 5, the development roller 32 is provided with space holding members 38 placed at both of the end portions of the development roller 32, and the development roller 32 is held with an extremely small gap formed between the development roller 32 and the photosensitive drum 62 due to abutment between the space holding members 38 and the photosensitive drum 62. Further, as illustrated in FIG. 3, a development sheet member 33 for preventing the toner T from leaking from the development unit 20 is provided at an edge portion of a bottom member 22 so as to abut against the development roller 32. Further, the conveyance member 43 is provided in the toner chamber 29 formed by the developer container 23 and the bottom member 22. The conveyance member 43 conveys the toner T into the toner supply chamber 28 along with stirring the toner T stored in the toner chamber 29.

As illustrated in FIGS. 4 and 5, the cartridge B is formed by joining the drum unit 60 and the development unit 20 to each other.

When the development unit 20 and the drum unit 60 are joined, first, a center of a development first support boss 26*a* of the bearing member 26 is aligned with a first suspension hole 71*i* on the driven side of the drum frame member 71, and a center of a development second support boss 27*a* of the bearing member 27 is aligned with a second suspension hole 71*j* on the non-driven side. More specifically, the development first support boss 26*a* and the development second support boss 27*a* are fitted in the first suspension hole 71*i* and the second suspension hole 71*j*, respectively, by moving the development unit 20 in a direction indicated by an arrow G. In this way, the development unit 20 is movably coupled with the drum unit 60. More specifically, the development unit 20 is rotationally movably (rotatably) coupled with the drum unit 60. In other words, the development roller 32 is coupled with the photosensitive drum 62 in a contactable and separable state. After that, the cartridge B is assembled by mounting the drum bearing 73 on the drum unit 60.

In the present exemplary embodiment, a driven-side biasing member 46L (see FIG. 5) and a non-driven side biasing member 46R (see FIG. 4) are made of compression springs. The cartridge B is configured to reliably press the development roller 32 in a direction toward the photosensitive drum 62 by causing the driven-side biasing member 46L and the non-driven-side biasing member 46R to bias the development unit 20 toward the drum unit 60 using biasing forces of these springs. Further, the cartridge B includes the space holding members 38 placed at both the end portions of the development roller 32. In other words, the photosensitive drum 62 and the development roller 32 are in contact with each other with a predetermined contact pressure via the space holding members 38, by which the development roller 32 is held while being separated from the photosensitive drum 62 by a predetermined distance and relative positions thereof are determined.

In this case, it is desirable that the distance between the photosensitive drum 62 and the development roller 32 is accurately kept at a constant distance to stably develop the electrostatic latent image on the photosensitive drum 62 with the toner T borne on the circumferential surface of the development roller 32. In other words, the contact pressure should be kept stable when the photosensitive drum 62 and the development roller 32 are in contact with each other via the space holding members 38.

[Mounting of Cartridge]

Next, the mounting of the cartridge B onto the apparatus main body A will be specifically described with reference to FIGS. 6A to 9C.

Figure 6A:
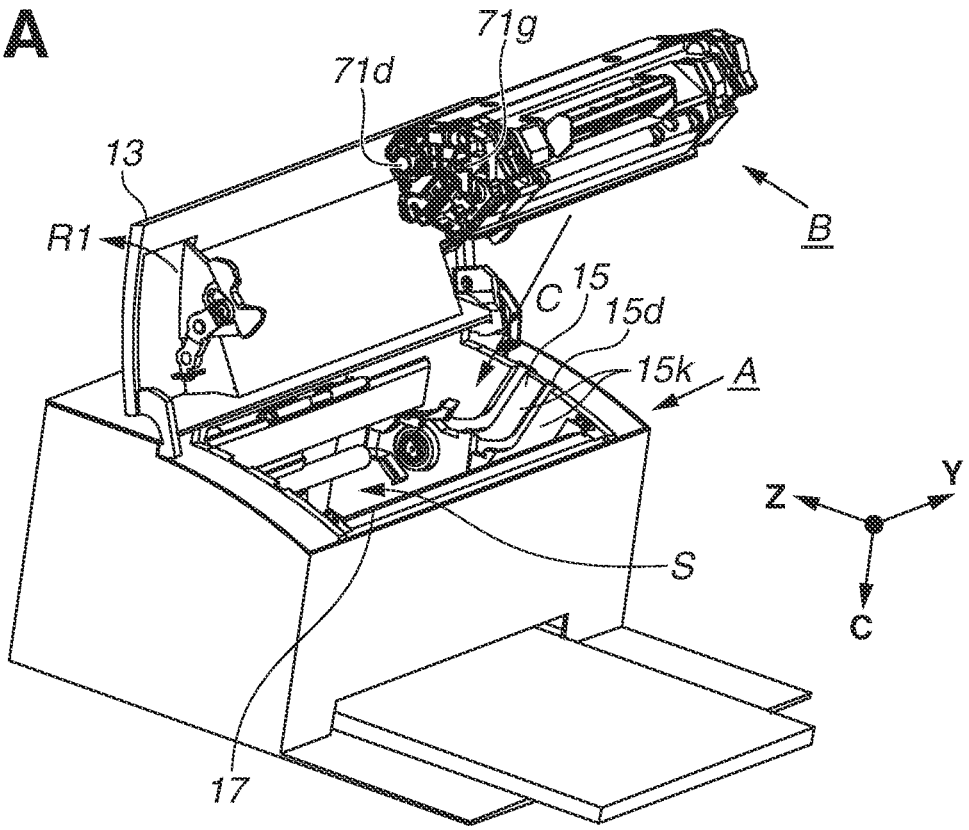
FIGS. 6A and 6B are perspective diagrams of the image forming apparatus.
Figure 6B:
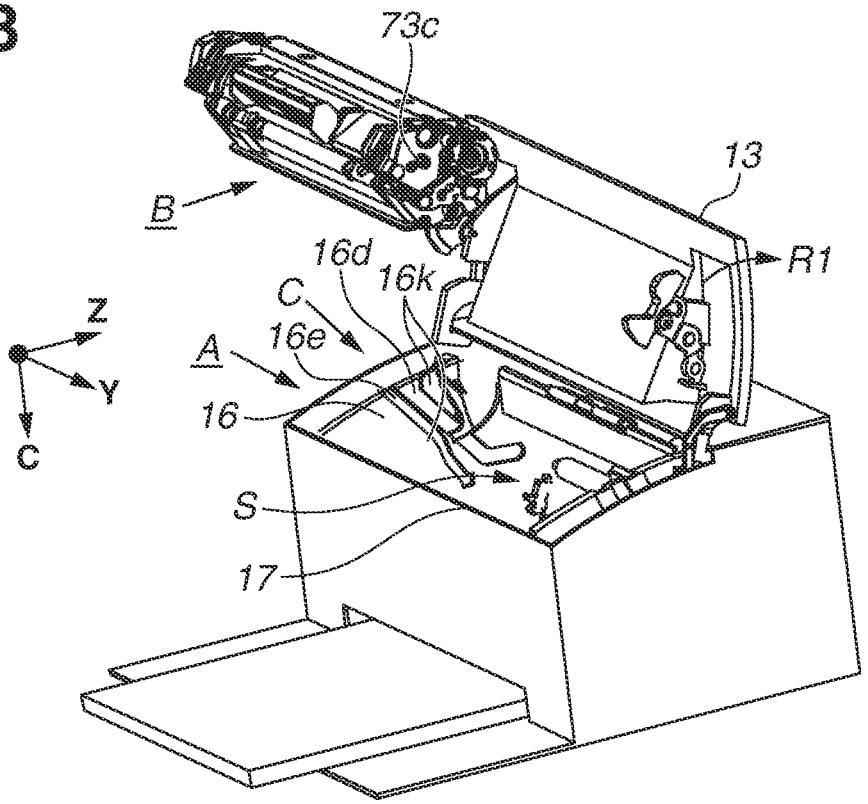
Figure 7A:
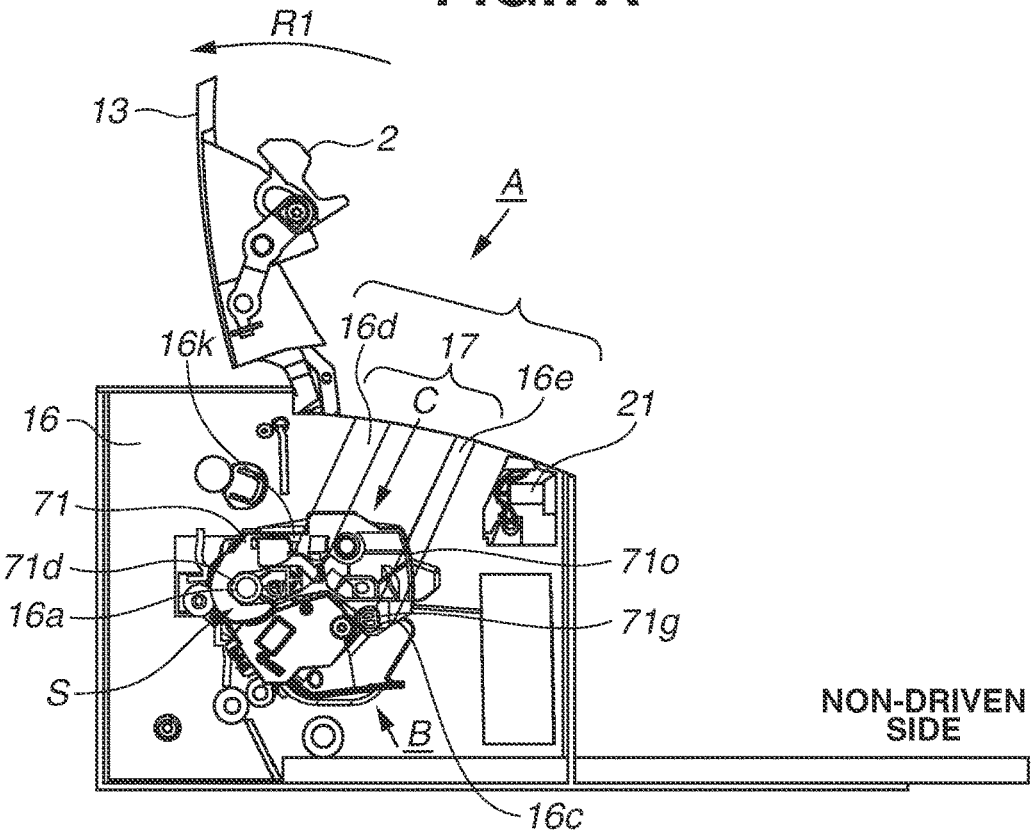
FIGS. 7A and 7B are cross-sectional diagrams schematically illustrating the image forming apparatus.
Figure 7B:
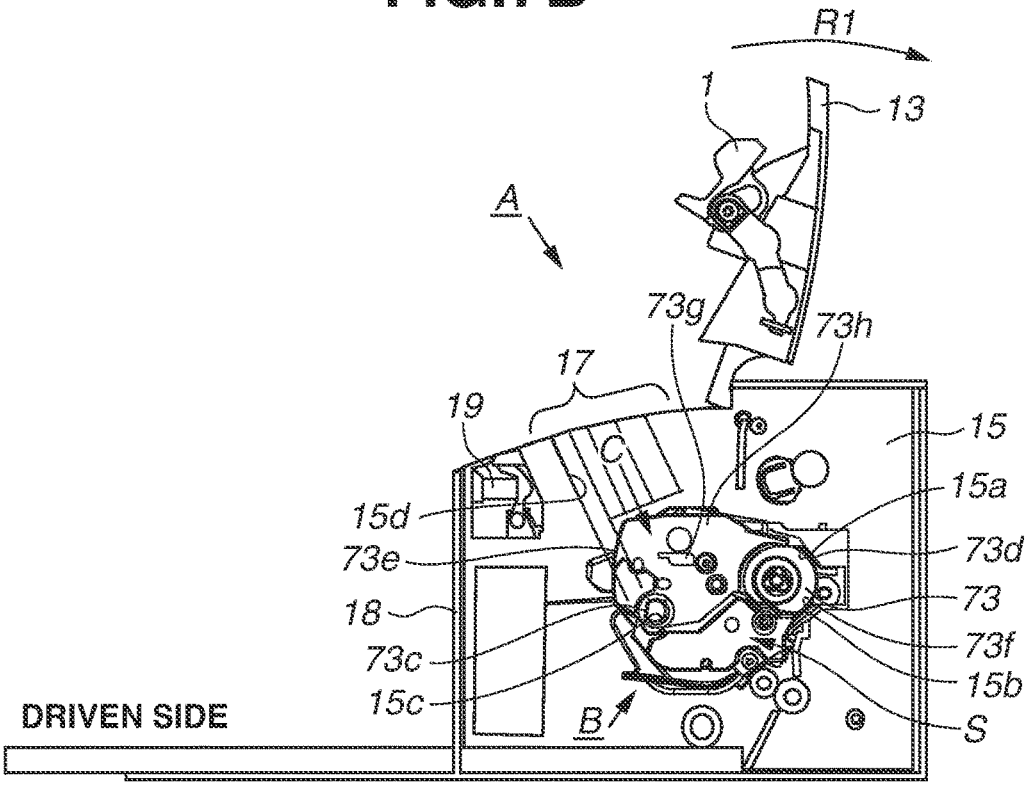
Figure 8A:
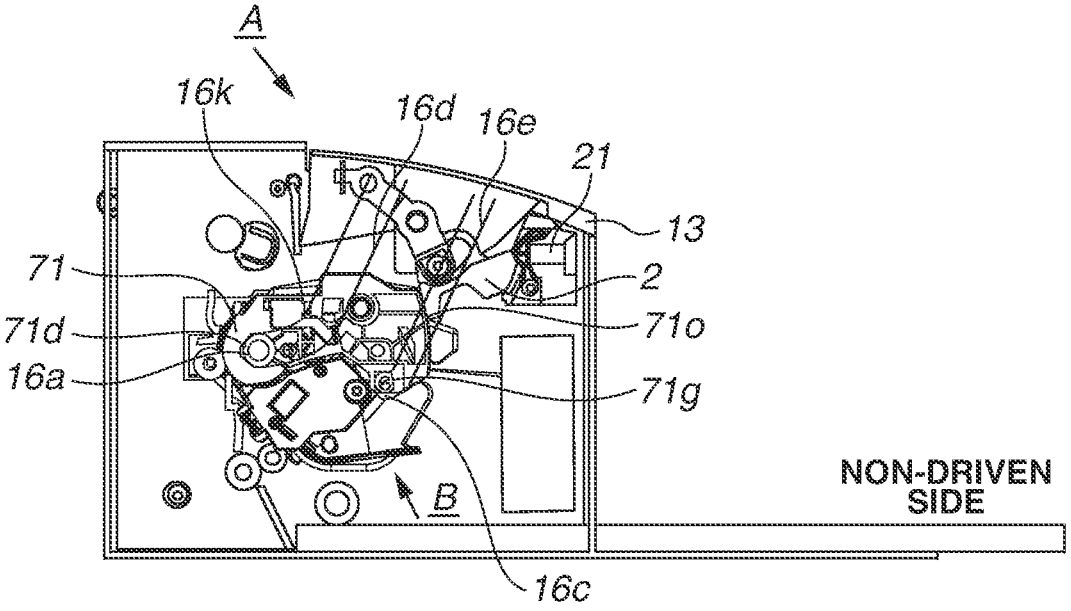
FIGS. 8A and 8B are cross-sectional diagrams schematically illustrating the image forming apparatus.
Figure 8B:
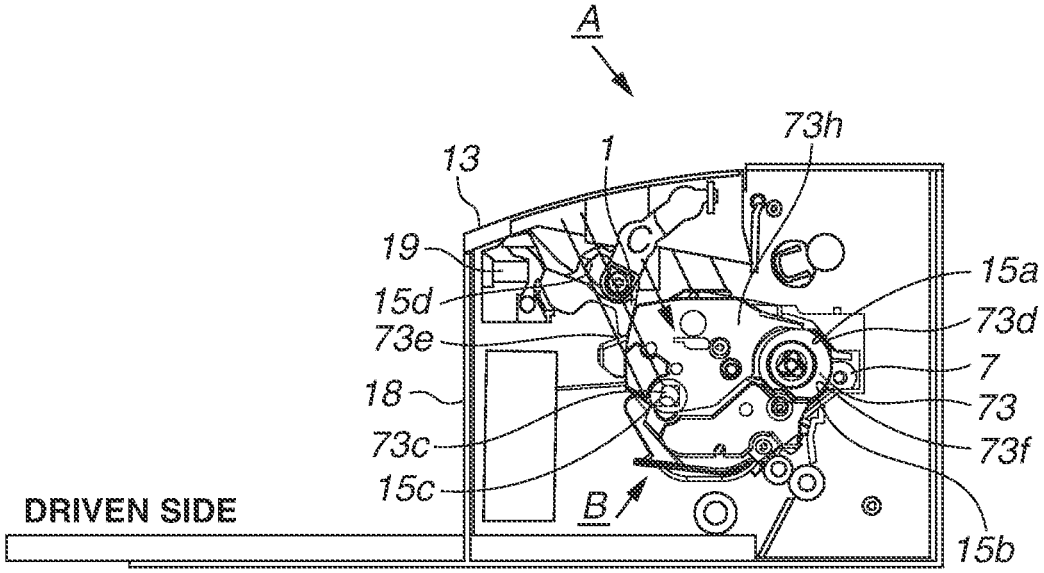
Figure 9A:
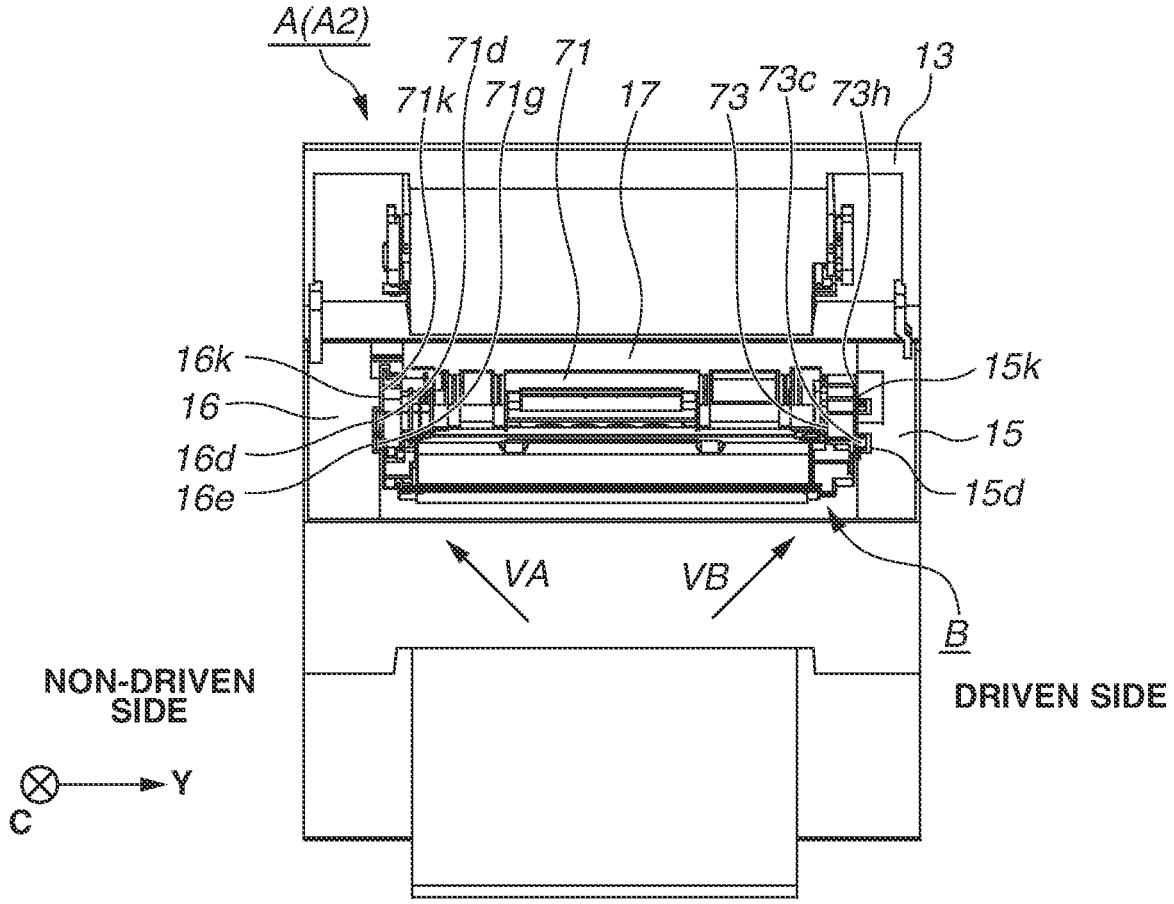
FIGS. 9A, 9B, and 9C are a schematic diagram illustrating the image forming apparatus viewed from a direction in which the cartridge is mounted, and partial diagrams viewed from directions indicated by arrows, respectively.
Figure 9B:
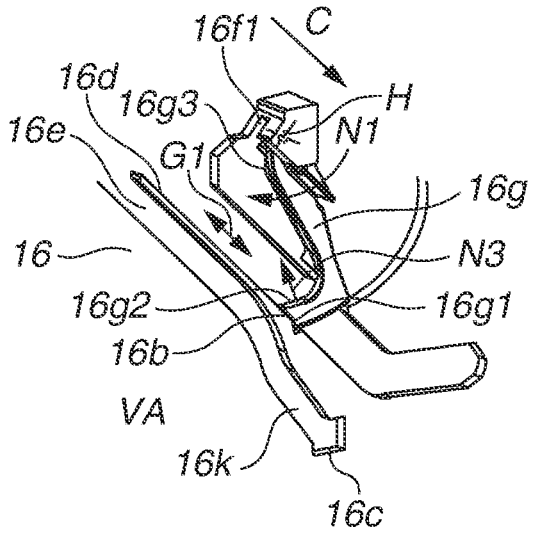
Figure 9C:
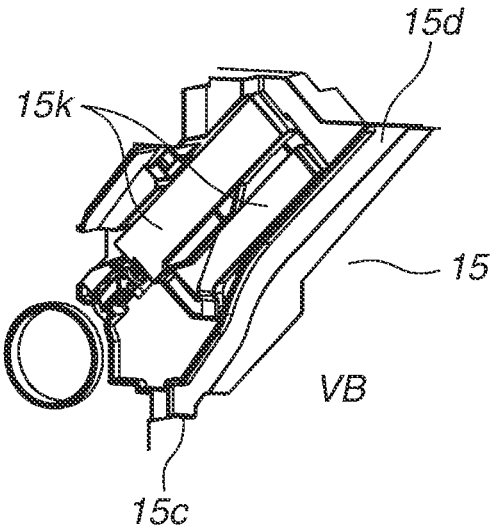

FIGS. 6A to 8B illustrate a portion of the apparatus main body A on which the cartridge B is mounted. More specifically, FIGS. 6A and 6B are perspective views. FIGS. 7A and 8A are side views of the non-driven side. FIGS. 7B and 8B are side views of the driven side. FIGS. 9A, 9B, and 9C illustrate the image forming apparatus when the cartridge B is mounted on the apparatus main body A, and illustrate the image forming apparatus when a downstream side is viewed from an upstream side in a mounting direction C in which the cartridge B is mounted.

As illustrated in FIGS. 6A, 6B, 7A, and 7B, the apparatus main body A is provided with an open/close door 13 for exposing and shielding a mounting portion S on which the cartridge B is mounted. To mount the cartridge B, the mounting portion S on which the cartridge B is mounted and a cartridge insertion port 17, which is an entrance when the cartridge B is mounted, are exposed by rotating the open/close door 13 in a direction indicated by an arrow R1. This allows the cartridge B to be mounted on the apparatus main body A in a direction intersecting the longitudinal direction Y (mounting direction C). The mounting portion S is a portion on which the cartridge B is mounted eventually in the apparatus main body A. In the present exemplary embodiment, the apparatus main body A can form an image by using the cartridge B with the cartridge B mounted on the mounting portion S.

A non-driven-side guide 16 is provided on the non-driven side of the mounting portion S as illustrated in FIGS. 6A and 6B, 7A and 7B, and 9A, 9B, and 9C. The non-driven-side guide 16 includes a non-drive-side upper guide 16*d* and a non-driven-side lower guide 16*e* cutout along the mounting direction C, and a side surface 16*k* located on an inner side of the non-driven side that faces the mounting portion S. On the other hand, a driven-side guide 15 is provided on the driven side of the mounting portion S. The driven-side guide 15 includes a side surface 15*k* located on an inner side of the driven side that faces the mounting portion S, and a driven-side guide portion 15*d* cutout along the mounting direction C. Further, a guided portion, with which the cartridge B is guided to be mounted onto the apparatus main body A, is provided on the cartridge B.

First, as illustrated in FIGS. 9A, 9B, and 9C, and FIG. 5, an end surface 71*k* intersecting the longitudinal direction Y, a positioned portion (restricted portion) 71*d* protruding from the end surface 71*k* outward in the longitudinal direction Y, and a rotation prohibited portion 71*g* are provided on the non-driven side of the drum frame member 71. On the other hand, an end surface 73*h* intersecting the longitudinal direction Y, and a rotation regulating portion 73*c* protruding from the end surface 73*h* outward in the longitudinal direction Y are provided on the drum bearing 73 on the driven side.

As illustrated in FIGS. 9A, 9B, and 9C, when the cartridge B is mounted on the apparatus main body A from the cartridge insertion port 17, the end surface 71*k* on the non-driven side of the cartridge B and the end surface 73*h* on the driven side face the side surface 16*k* located on the inner side of the non-driven side and the side surface 15*k* located on the inner side of the driven side in proximity thereto, respectively. As a result, a position (track) in the longitudinal direction Y during a process of mounting the cartridge B is determined.

Further, the positioned portion 71*d* and the rotation regulating portion 71*g* are guided by the non-driven-side upper guide 16*d* and the non-driven-side lower guide 16*e* on the non-driven side of the cartridge B, respectively. The rotation regulating portion 73*c* is guided by the driven-side guide portion 15*d* on the driven side of the cartridge B.

When the cartridge B is moved toward the mounting portion S, a position (track) of the cartridge B in a direction intersecting the mounting direction C and the longitudinal direction Y (this direction will be referred to as a vertical direction Z) is determined. In this way, the cartridge B is mounted onto the apparatus main body A following the determined mounting track (the mounting direction C).

Next, how the open/close door 13 is closed will be described. As illustrated in FIGS. 7A, 7B, 8A, and 8B, the driven-side guide 15 includes a first positioning portion 15*a* and a second positioning portion 15*b* as positioning portions, and a rotation prohibition portion 15*c*, and the non-driven-side guide 16 includes a positioning portion 16*a* and a rotation prohibition portion 16*c*. The drum bearing 73 includes a first positioned portion 73*d* and a rotation regulated portion 73*f*.

Further, cartridge pressing members 1 and 2 are rotatably attached at both ends of the open/close door 13 in a direction along a rotational axis of the open/close door 13. Cartridge pressing springs 19 and 21 are attached at both ends of a front plate provided on the apparatus main body A in the longitudinal direction Y. The drum bearing 73 includes a pressed portion 73*e* as a biasing force reception portion, and the drum frame member 71 includes a pressed portion 710 on the non-driven side. Closing the open/close door 13 causes the pressed portions 73*e* and 710 of the cartridge B to be pressed by the cartridge pressing members 1 and 2 biased by the cartridge pressing springs 19 and 21 of the apparatus main body A (refer to FIGS. 8A and 8B).

With this configuration, the first positioned portion 73*d*, the rotation regulated portion 73*f*, and the rotation regulating portion 73*c* of the cartridge B are brought into abutment with the first positioning portion 15*a*, the second positioning portion 15*b*, and the rotation prohibition portion 15*c* of the apparatus main body A, respectively, on the driven side. As a result, the cartridge B and the photosensitive drum 62 are positioned on the driven side. Further, the positioned portion 71*d* and the rotation regulating portion 71*g* of the cartridge B are brought into abutment with the positioning portion 16*a* and the rotation prohibition portion 16*c* of the apparatus main body A, respectively, on the non-driven side. In this way, the cartridge B and the photosensitive drum 62 are positioned on the non-driven side.

As described above, the cartridge B is mounted onto the mounting portion S of the apparatus main body A. The above-described configuration is an example of the configuration for determining the position of the cartridge B with respect to the apparatus main body A, and is not described with the intention to set any limit on the unit as the positioning means. The image forming apparatus may be configured to directly work on the positioned portion 71*d* and the rotation regulating portion 71*g* on the non-driven side of the cartridge B and the first positioned portion 73*d* and the rotation regulated portion 73*f* on the driven side and fix each of the positioning portions.

[Erroneous Mounting Prevention System]

Figure 1B:
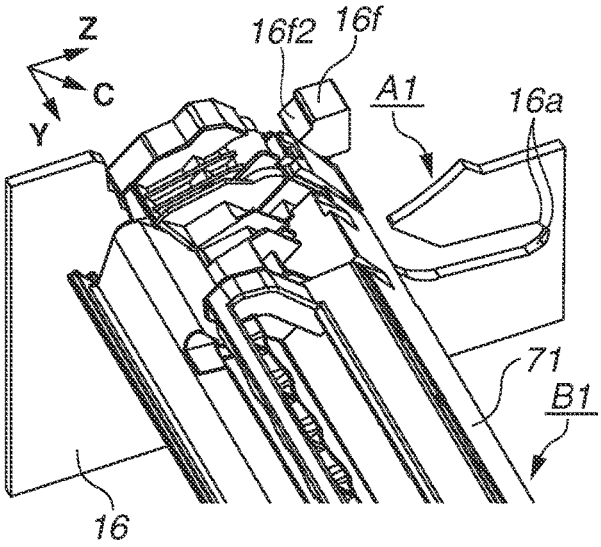
Figure 1C:
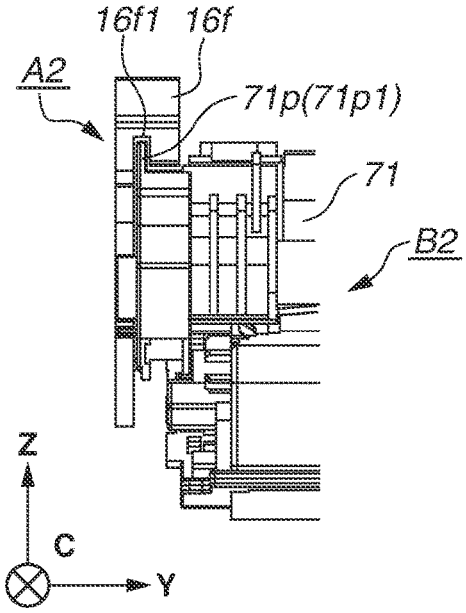
Figure 1D:
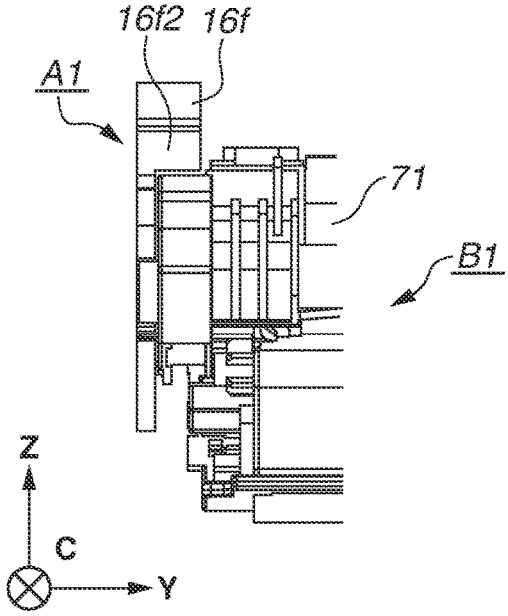

An erroneous mounting prevention system according to the present exemplary embodiment will be described with reference to FIGS. 9A, 9B, and 9C and FIGS. 1A to 13. FIGS. 1A to 1D illustrate the erroneous mounting prevention system according to the present exemplary embodiment. FIGS. 1A and 1C illustrate the second cartridge B2 and the second apparatus main body A2, and FIGS. 1B and 1D illustrate the first cartridge B1 and the first apparatus main body A1.

A rib 71*p* (protruding portion) as an identified portion extending in the direction intersecting the longitudinal direction Y and the mounting direction C (vertical direction Z) is provided at the end portion of the second cartridge B2 on the non-driven side as illustrated in FIGS. 1A and 1C.

An identification rail 16*f* is provided on the second apparatus main body A2. The identification rail 16*f* includes a cutout portion 16*f*1 (a recessed portion) as a guide portion, which is provided along the mounting direction C, at a position that matches the rib 71*p* of the second cartridge B2 in the longitudinal direction Y. Further, a movable lever 16*g* (restriction member) is provided at the non-driven-side guide 16 on the second apparatus main body A2 as illustrated in FIG. 9B. The movable lever 16*g* is configured to be rotatable around an axis center H, and is biased in a direction indicated by an arrow N1 by a biasing member (not illustrated). A home position of the movable lever 16g corresponds to a restriction position at which a restricted surface 16g1 of the movable lever 16g is in contact with a restriction surface 16b provided on the non-driven-side guide 16. In other words, the movable lever 16g is located at the restriction position unless the movable lever 16g is moved by applying a force from outside. The movable lever 16g intrudes in a mounting route G1 of the positioned portion 71d of the second cartridge B2 when the movable lever 16g is located at the restriction position. Further, the movable lever 16g includes a first abutted surface 16g3 on the downstream side of the cutout portion 16f1 in the mounting direction C. At the restriction position, the abutment surface 16g3 (first abutted surface) is a surface intersecting the mounting direction C and the direction indicated by the arrow N1 (direction tangential to a circle centered at the axis center H) and having a normal direction extending in the direction indicated by the arrow N1. Further, a lever restriction surface 16g2 is provided near the restricted surface 16g1 of the movable lever 16g. The surface of the lever restriction surface 16g2 (second abutted surface) is a surface intersecting the mounting direction C and having a normal direction extending in a direction indicated by an arrow N3.

Figure 12A:
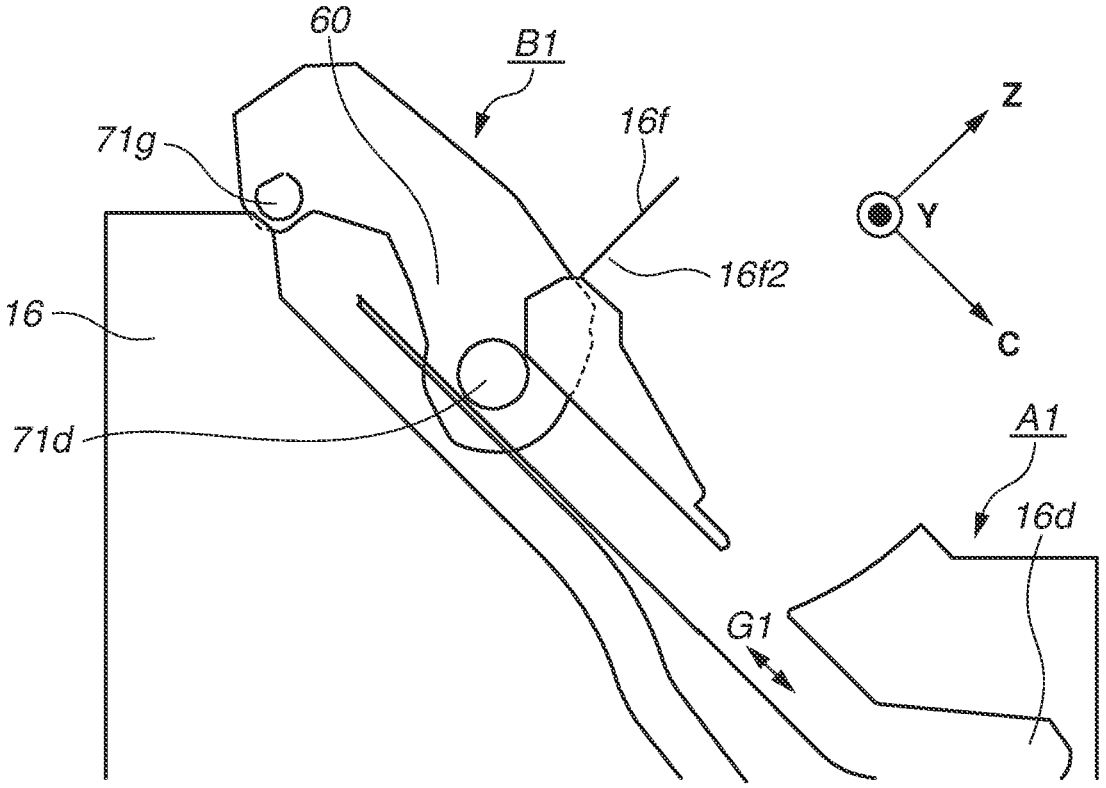
FIGS. 12A and 12B are diagrams illustrating an operation of the erroneous mounting prevention mechanism when a compatible cartridge is inserted into the image forming apparatus.
Figure 12B:
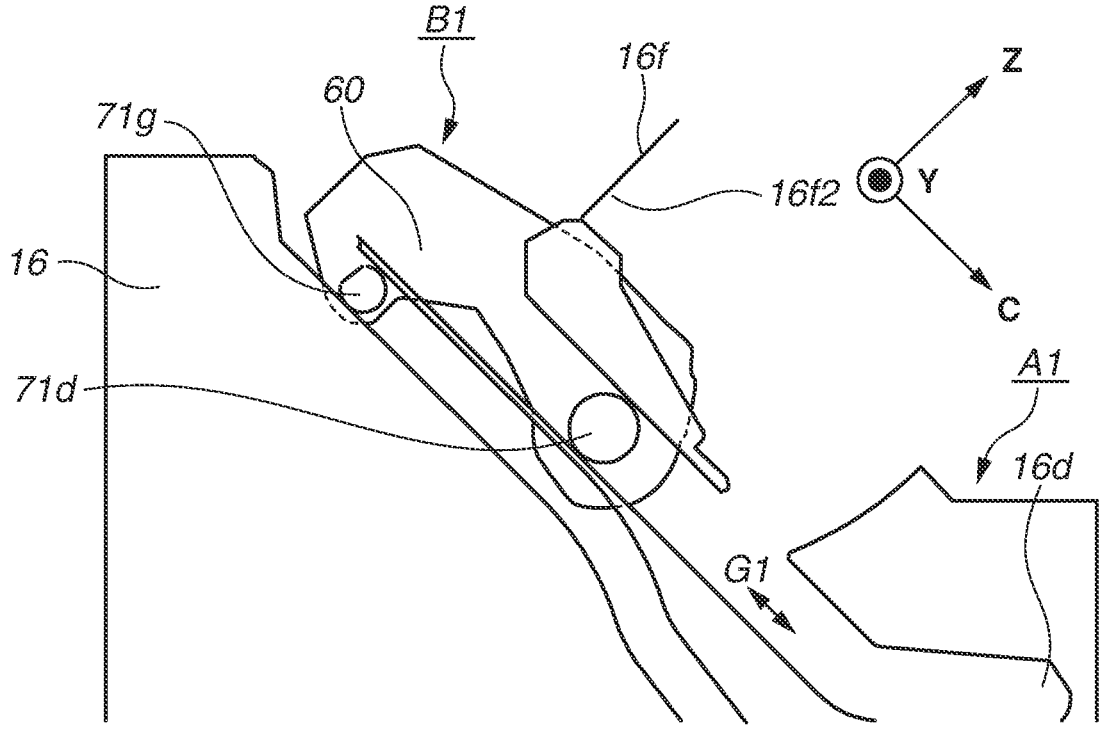

On the other hand, no portion corresponding to the rib 71p of the second cartridge B2 is provided at the end portion of the first cartridge B1 on the non-driven side as illustrated in FIGS. 1B and 1D in the present exemplary embodiment. Further, the first apparatus main body A1 is provided with no portion corresponding to the cutout portion 16f1 of the second apparatus main body A2, but instead is provided with a surface portion 16f2, which is a surface intersecting the mounting direction C. Further, the first apparatus main body A1 is not provided with a member corresponding to the movable lever 16g of the second apparatus main body A2 as illustrated in FIGS. 12A and 12B. A rib or a protruding portion having a height set so as to allow it to pass through below the surface portion 16f2 of the first apparatus main body A1 and prevent it from abutting against the abutted surface 16g3 of the movable lever 16g may be provided at the end portion of the first cartridge B1 on the non-driven side.

<Mounting of Second Cartridge B2 onto Second Apparatus Main Body A2>

A configuration that allows the second cartridge B2 to be mounted on the second apparatus main body A2 will be described with reference to FIGS. 10A, 10B, 10C, 10D, and 10E. FIGS. 10A to 10E are cross-sectional diagrams illustrating cross-sections perpendicular to the longitudinal direction Y that illustrate a process of mounting the second cartridge B2 onto the second apparatus main body A2. FIGS. 10A to 10E illustrate only the non-driven-side guide 16 and the drum unit 60 for the sake of convenience. Further, only the drum unit 60 and the movable lever 16g are hatched so as to easily understand the shapes of the parts in FIG. 10A, but the hatching is omitted in FIGS. 10B to 10E.

Figure 10A:
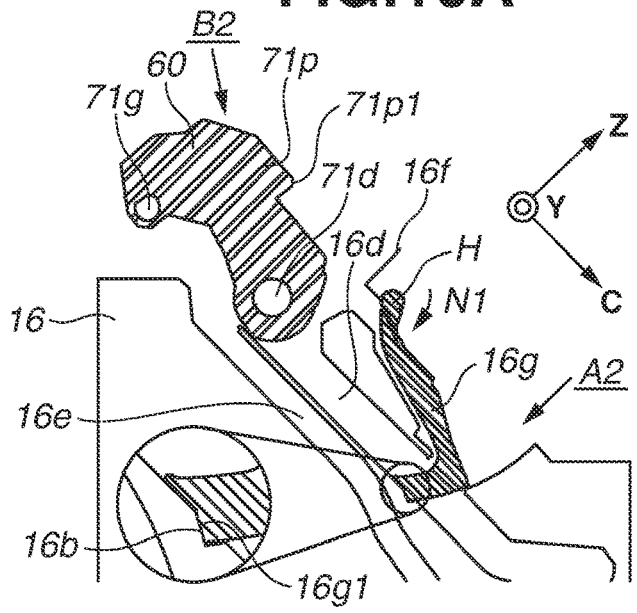
FIGS. 10A, 10B, 10C, 10D, and 10E are diagrams illustrating an operation of an erroneous mounting prevention mechanism when a compatible cartridge is inserted into the image forming apparatus.
Figure 10B:
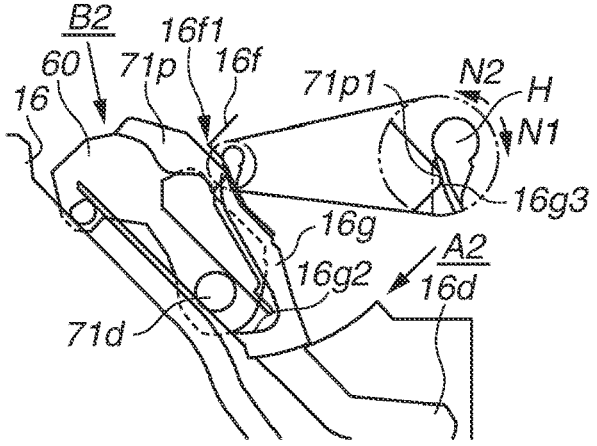
Figure 10C:
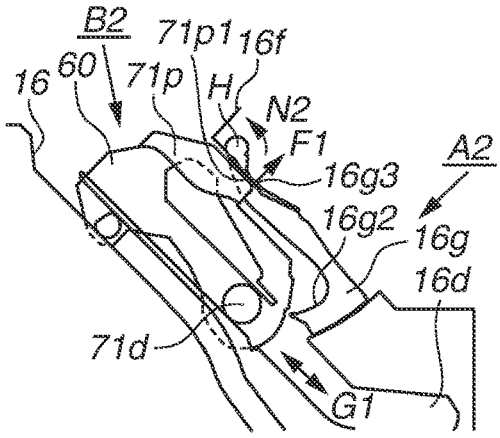

As illustrated in FIG. 10B, when the second cartridge B2 is moved in the mounting direction C to mount it on the second apparatus main body A2, the rib 71p (first protruding portion) passes through the cutout portion 16f1 (first recessed portion) of the identification rail 16f. Then, a first abutment portion 71p1 of the rib 71p is brought into abutment with the abutment surface 16g3 of the movable lever 16g. When the second cartridge B2 is further moved in the mounting direction C, a user's force F1 is applied to the abutment surface 16g3 of the movable lever 16g via the first abutment portion 71p1 of the rib 71p. The movable lever 16g is rotated in a direction indicated by an arrow N2 to be moved from the restriction position to a non-restriction position by this force F1. The abutment surface 16g3 of the movable lever 16g is configured to generate a rotational moment in a direction for rotating the movable lever 16g from the restriction position to the non-restriction position when the first abutment surface 71p1 of the rib 71p is brought into abutment therewith.

Figure 10D:
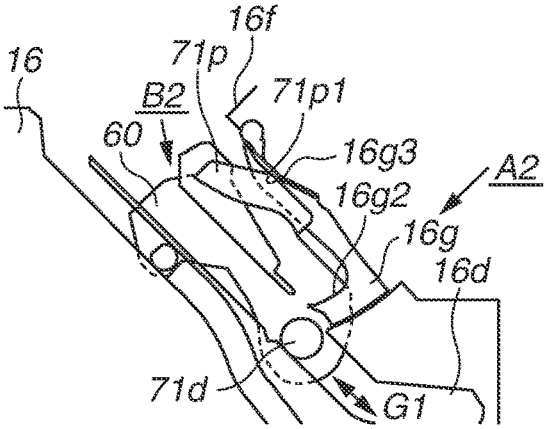
Figure 10E:
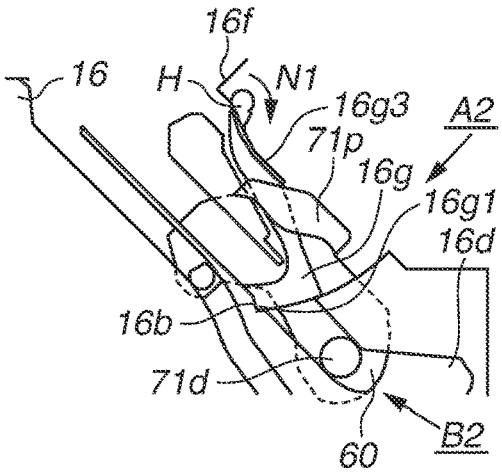

The non-restriction position is a position to which the movable lever 16g is retracted from the mounting route G1 (FIG. 9B) of the positioned portion 71d of the second cartridge B2. In other words, when the movable lever 16g is located at the non-restriction position, the positioned portion 71d can move without being restricted by the movable lever 16g. When the second cartridge B2 is further moved, the positioned portion 71d passes through the lever restriction surface 16g2 with the rib 71p in abutment with the abutment surface 16g3 and the movable lever 16g located at the non-restriction position as illustrated in FIG. 10D. Then, the rib 71p passes through the abutment surface 16g3, and the mounting of the second cartridge B2 on the second apparatus main body A2 is completed. At this time, because the rib 71p and the abutment surface 16g3 stop abutting against each other, the movable lever 16g is returned by the biasing force of the biasing member (not illustrated) to the restriction position, which is the home position thereof (see FIG. 10E).

In this way, when the second cartridge B2 compatible with the second apparatus main body A2 is mounted onto the second apparatus main body A2, the rib 71p passes through the cutout portion 16f1 of the identification rail 16f and causes the rotation of the movable lever 16g. Then, the movable lever 16g is rotated from the restriction position to the non-restriction position, by which the second cartridge B2 is allowed to be mounted on the second apparatus main body A2 without the positioned portion 71d being restricted by the lever restriction surface 16g2.

<Mounting of First Cartridge B1 onto Second Apparatus Main Body A2>

Figure 11:
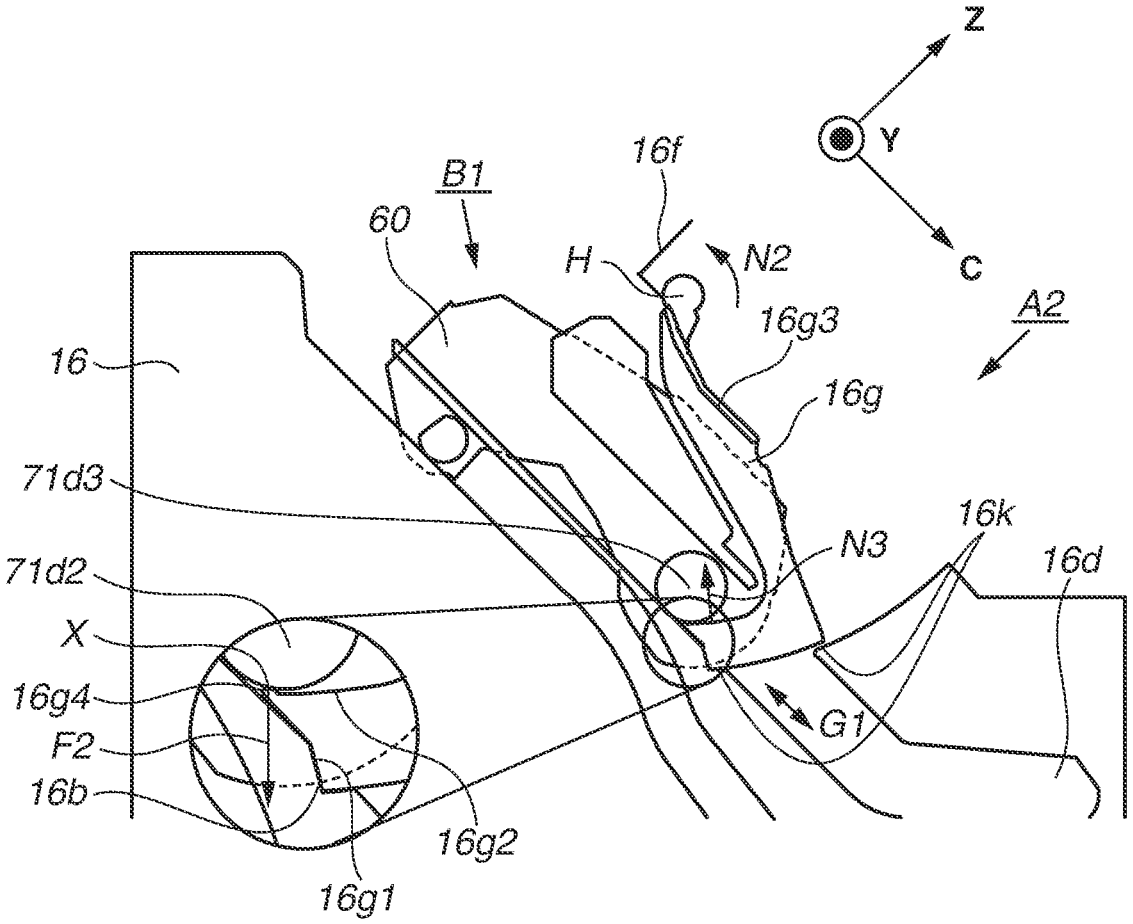
FIG. 11 is a diagram illustrating an operation of the erroneous mounting prevention mechanism when an incompatible cartridge is inserted into the image forming apparatus.

A configuration that prevents the first cartridge B1 from being erroneously mounted on the second apparatus main body A2 will be described. FIG. 11 is a cross-sectional diagram illustrating a cross-section perpendicular to the longitudinal direction Y when the user attempts to mount the first cartridge B1 on the second apparatus main body A2. FIG. 11 illustrates only the non-driven-side guide 16 and the drum unit 60.

Because the first cartridge B1 include no portion corresponding to the rib 71p of the second cartridge B2, the first cartridge B1 is moved in the mounting direction C without the drum frame member 71 interfering with the identification rail 16f on the non-driven side. Further, the first cartridge B1 is moved in the mounting direction C without abutting against the abutment surface 16g3 of the movable lever 16g. The positioned portion 71d of the first cartridge B1 is brought into abutment with the lever restriction surface 16g2 of the movable lever 16g located at the restriction position. Then, a force F2 is applied from the user to the lever restriction surface 16g2 via the positioned portion 71d2. However, because the lever restriction surface 16g2 is the surface having the normal line facing the direction indicated by the arrow N3, the force F2 works in a direction for rotating the movable lever 16g in the direction indicated by the arrow N1 (the direction from the non-restriction position toward the restriction position). The lever restriction surface 16g2 is configured to generate a rotational moment in a direction for rotating the movable lever 16g from the non-restriction position to the restriction position when the positioned portion 71*d* is brought into abutment therewith.

Accordingly, the movable lever 16*g* cannot be moved more than that, and is kept in a state intruding in the mounting route G1. Thus, the first cartridge B1 is prevented from being erroneously mounted on the second apparatus main body A2.

<Mounting of First Cartridge B1 onto First Apparatus Main Body A1>

A configuration that allows the first cartridge B1 to be mounted on the first apparatus main body A1 will be described with reference to FIGS. 12A and 12B. The identification rail 16*f* is provided with no portion corresponding to the cutout portion 16*f*1 of the second apparatus main body A2, but is provided with the surface portion 16*f*2 instead of the cutout portion 16*f*1. On the other hand, because the first cartridge B1 includes no portion corresponding to the rib 71*p* of the second cartridge B2, the first cartridge B1 is moved in the mounting direction C without interfering with the surface portion 16*f*2. Further, because the first apparatus main body A1 includes no member corresponding to the movable lever 16*g* of the second apparatus main body A2, the positioned portion 71*d* of the first cartridge B1 does not interfere with any portion. Therefore, the first cartridge B1 is allowed to be mounted on the first apparatus main body A1.

<Mounting of Second Cartridge B2 onto First Apparatus Main Body A1>

A configuration that prevents the second cartridge B2 from being erroneously mounted on the first apparatus main body A1 will be described with reference to FIG. 13.

Figure 13:
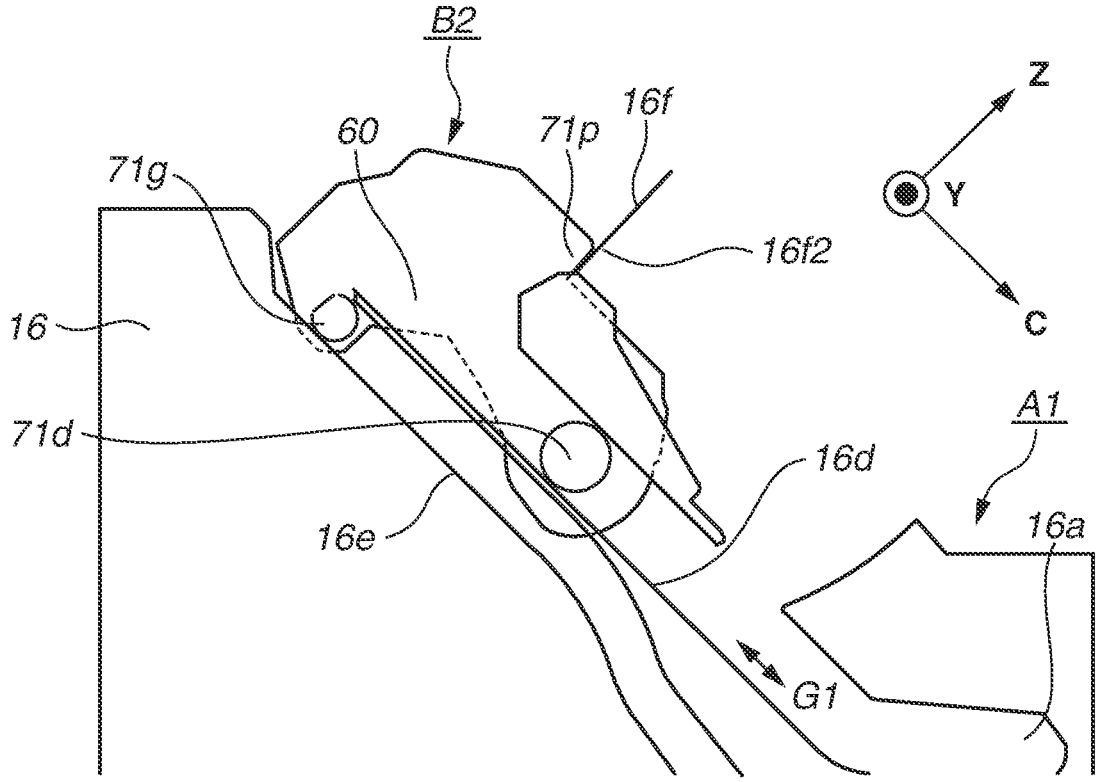
FIG. 13 is a diagram illustrating an operation of the erroneous mounting prevention mechanism when an incompatible cartridge is inserted into the image forming apparatus.

As illustrated in FIG. 13, when the user attempts to mount the second cartridge B2 on the first apparatus main body A1, the positioned portion 71*d* and the rotation regulating portion 71*g* are guided by the non-driven-side upper guide 16*d* and the non-driven-side lower guide 16*e*, respectively. As a result, the position of the second cartridge B2 in the vertical direction Z is determined. When the second cartridge B2 is further moved in the mounting direction C in this state, the rib 71*p* is brought into abutment with the surface portion 16*f*2, by which the second cartridge B2 is prohibited from being moved in the mounting direction C and is prevented from being erroneously mounted on the first apparatus main body A1.

<Third Cartridge B3 and Third Apparatus Main Body A3>

Figure 14A:
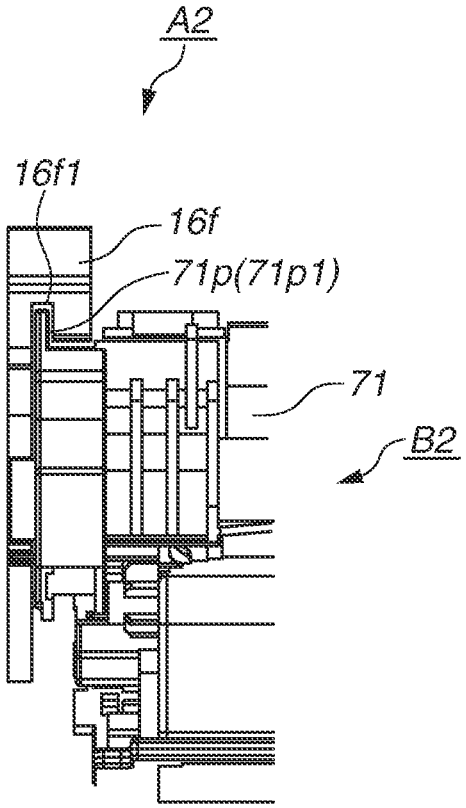
FIGS. 14A and 14B are diagrams illustrating an example of a configuration of an identification pattern of the image forming apparatus.
Figure 14B:
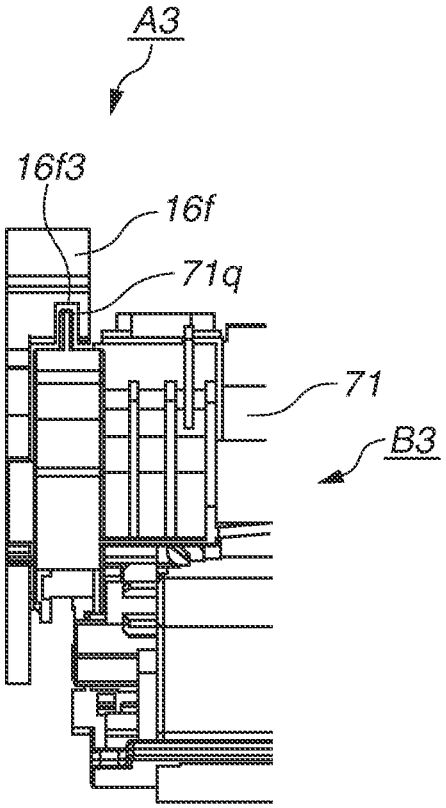
Figure 14B:
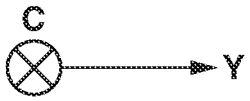

A third apparatus main body A3 and a third cartridge B3, as illustrated in FIGS. 14A and 14B, may be provided. The third apparatus main body A3 is equipped with a cutout portion 16*f*3 (third recessed portion), which is located at a different position from the cutout portion 16*f*1 of the second apparatus main body A2 in the longitudinal direction Y. The third cartridge B3 is provided with a rib 71*q*3 (third protruding portion) located at a different position from the rib 71*p* of the second cartridge B2 in the longitudinal direction Y.

When the user attempts to mount the third cartridge B3 on the first apparatus main body A1, the rib 71*q*3 is brought into abutment with the surface portion 16*f*2 and the third cartridge B3 is prohibited from being moved in the mounting direction C, and therefore the third cartridge B3 is prevented from being mounted on the first apparatus main body A1. When the user attempts to mount the third cartridge B3 on the second apparatus main body A2, the result thereof is as follows. Because the rib 71*q*3 and the cutout portion 16*f*1 (first recessed portion) of the identification rail 16*f* are located at the different positions from each other, the rib 71*q*3 cannot pass through the cutout portion 16*f*1 and thus the third cartridge B3 is prevented from being mounted on the second apparatus main body A2. When the user attempts to mount the third cartridge B3 on the third apparatus main body A3, the rib 71*q*3 passes through the cutout 16*f*3, by which the third cartridge B3 is allowed to be mounted on the third apparatus main body A3.

In the above-described manner, according to the present exemplary embodiment, the erroneous mounting prevention system can be constructed using the simply structured apparatus main body (first apparatus main body A1). Further, compatible/incompatible combinations can also be increased by setting the third apparatus main body and the third cartridge.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-034906, filed Feb. 27, 2019, which is hereby incorporated by reference herein in its entirety.

What is claimed is:

1. An erroneous mounting prevention system comprising:

a first cartridge including a first restricted portion;

a second cartridge including a protruding portion and a second restricted portion;

a first apparatus main body configured to allow the first cartridge to be mounted thereon and prevent the second cartridge from being mounted thereon; and a second apparatus main body configured to prevent the first cartridge from being mounted and allow the second cartridge to be mounted on the second apparatus main body, the second apparatus main body including a recessed portion and a restriction member configured to be movable between a restriction position in which the first and second cartridges are restricted to be mounted thereon and a non-restriction position in which the first and second cartridges are not restricted to be mounted thereon, wherein the first cartridge includes no portion corresponding to the protruding portion of the second cartridge, and the first apparatus main body includes a surface portion at a position corresponding to the recessed portion of the second apparatus main body and includes no member corresponding to the restriction member of the second apparatus main body, wherein by moving the second cartridge in a mounting direction to mount the second cartridge on the second apparatus main body, the protruding portion passes through the recessed portion and is brought into abutment with the restriction member to move the restriction member from the restriction position to the non-restriction position, thereby the second restricted portion passes through a region in which the restriction member is located when the restriction member is in the restriction position, so that the second cartridge is allowed to be mounted on the second apparatus main body, wherein by moving the first cartridge in the mounting direction to mount the first cartridge on the second apparatus main body, the first restricted portion is brought into abutment with the restriction member located at the restriction position, thereby the first cartridge is restricted to be moved in the mounting direction and is prevented from being mounted on the second apparatus main body, wherein by moving the second cartridge in the mounting direction to mount the second cartridge on the first apparatus main body, the protruding portion is brought into abutment with the surface portion, thereby the second cartridge is restricted to be moved in the mounting direction and is prevented from being mounted on the first apparatus main body, and wherein by moving the first cartridge in the mounting direction to mount the first cartridge on the first apparatus main body, the first cartridge is mounted on the first apparatus main body without being restricted from being moved by the surface portion.

2. The erroneous mounting prevention system according to claim 1, wherein the second restricted portion is a positioned portion with which the second cartridge is positioned relative to the second apparatus main body in the direction in which the second cartridge is mounted, and wherein the first restricted portion is a positioned portion with which the first cartridge is positioned relative to the first apparatus main body in the direction in which the first cartridge is mounted.

3. The erroneous mounting prevention system according to claim 1, wherein the restriction member is provided to be rotatable around a rotational axis extending in a direction intersecting the direction in which the second cartridge is mounted, and wherein the restriction member includes a second abutted surface with which the protruding portion of the second cartridge is brought into abutment and a first abutted surface with which the first restricted portion of the first cartridge is brought into abutment, the second abutted surface being configured to generate a rotational moment in a direction for rotating the restriction member from the restriction position to the non-restriction position when the protruding portion is brought into abutment therewith, the first abutted surface being configured to generate a rotational moment in a direction for rotating the restriction member from the non-restriction position to the restriction position when the first restricted portion is brought into abutment therewith.

4. The erroneous mounting prevention system according to claim 1, further comprising a third apparatus main body and a third cartridge, wherein the third apparatus main body includes, assuming that the recessed portion is a first recessed portion, a third recessed portion at a position different from a position corresponding to the first recessed portion of the second apparatus main body, wherein the third cartridge includes, assuming that the protruding portion is a first protruding portion, a third protruding portion at a position different from a position corresponding to the first protruding portion of the second cartridge, wherein by moving the third cartridge in the mounting direction to mount the third cartridge on the second apparatus main body, the third protruding portion is unable to pass through the first recessed portion, so that the cartridge is prevented from being mounted on the second apparatus main body, wherein by moving the third cartridge in the mounting direction to mount the third cartridge on the first apparatus main body, the third protruding portion is brought into abutment with the surface portion, so that the third cartridge is prevented from being mounted on the first apparatus main body, and wherein by moving the third cartridge in the mounting direction to mount the third cartridge on the third apparatus main body, the third protruding portion passes through the third recessed portion, so that the third cartridge is allowed to be mounted on the third apparatus main body.

* * * * *